US005943722A

United States Patent [19]

Hamilton et al.

[11] Patent Number: 5,943,722

[45] Date of Patent: Aug. 31, 1999

[54] SURFACE TREATMENT DEVICE

[75] Inventors: Sheila Hamilton, Kilmacolm; Jonathan Kennett, Howwood; William Crookston, Kilmacolm, all of United Kingdom

[73] Assignee: Teknek Electronics Limited, Renfrewshire, United Kingdom

[21] Appl. No.: 08/973,455

[22] PCT Filed: May 31, 1996

[86] PCT No.: PCT/GB96/01290

§ 371 Date: Dec. 2, 1997

§ 102(e) Date: Dec. 2, 1997

[87] PCT Pub. No.: WO96/38306

PCT Pub. Date: Dec. 5, 1996

[30] Foreign Application Priority Data

Jun. 2, 1995 [GB] United Kingdom ..... 9511214

[51] Int. Cl.[6] ..... B08B 13/00

[52] U.S. Cl. ..... 15/3; 15/104.002; 492/27

[58] Field of Search ..... 118/110, 118, 118/249, 258, 500, DIG. 15; 427/428; 492/14, 27, 37, 53, 57, 59; 15/3, 104.002

[56] References Cited

U.S. PATENT DOCUMENTS 4,107,830 8/1978 Thomson ..... 492/14
5,456,169 10/1995 Rohwetter et al. .

FOREIGN PATENT DOCUMENTS 4332498 3/1995 Germany .
95/12494 5/1995 WIPO .
96/38306 12/1996 WIPO .

OTHER PUBLICATIONS

Patent Abstracts of Japan, vol. 010, No. 059 (M–459), Mar. 8, 1986, JP,A,60 204543, Matsushita Oct. 16, 1985.

Patent Abstracts of Japan, vol. 018, No. 276 (C–1204), May 26, 1994, JP,A,06 046987, Sekisui Chem Feb. 22, 1994.

*Primary Examiner*—Laura Edwards
*Attorney, Agent, or Firm*—Ratner & Prestia

[57] ABSTRACT

A contact cleaning machine for removing particulates and other undesirable debris from the surfaces of articles moving along a curved path under the cleaning machine, without disturbing the orientation of the articles which cannot be clamped against movement. Cleaning is performed by a roller (22) which is mounted in the machine to roll across the tops of articles as they pass underneath. The peripheral surface (28) of the roller is coated with a tacky adhesive to lift off the undesirable particles. To avoid the roller applying differential forces to the article, the roller is made conical and convergent towards the axis of curvature of the path followed by the article. The avoidance of differential forces on the unclamped articles eliminates any tendency for the cleaning roller to turn the articles. To prevent build-up of dirt on the cleaning roller, it is backed up by a further roller with a peripheral surface that has a greater level of adhesive tackiness, such that particulates transfer from the cleaning roller to the backup roller. The contact cleaning machine is applicable to cleaning the surfaces of compact discs having labels printed on them in a multi-stage indexing turret printing machine.

9 Claims, 5 Drawing Sheets

SURFACE TREATMENT DEVICE

FIELD OF THE INVENTION

This invention relates to surface treatment, and relates particularly, but not exclusively, to the surface treatment of articles moving in an arcuate path.

DESCRIPTION OF THE PRIOR ART

It is known to undertake the multi-stage processing of a workpiece or other article in an indexing turret machine, wherein the article is temporarily secured to a holder which is mounted on a rotatable arm or platform to be indexable through a series of workstations arranged in a circular path. For certain processes, it is essential that the article does not alter its alignment with respect to a reference direction, which may be the holder or its mounting arm. For example, in the multi-colour printing of a CD ("compact disc") wherein a single one of the colours is printed at each workstation on the indexing turret machine, the CD must not rotate about its own axis between workstations because such rotation would put the colours out of register. On the other hand, it may be required that the CD has its surface (the surface being printed) subjected to a cleaning treatment between workstations, eg to remove airborne particulates that have settled on the surface. Such cleaning treatment may be applied by indexing the CD under and in contact with a roller having a tacky surface. A conventional cleaning roller has a cylindrical surface which would not tend to rotate a CD passing under it in a straight-line path, but which undesirably would tend to rotate a CD about its own axis when the CD passes under the roller along the arcuate path inherent in use of an indexing turret machine. Since it may be difficult or impossible to prevent the CD rotating about it own axis while avoiding distortion or other unacceptable damage to the CD, the cleaning roller has to be re-designed to obviate or mitigate any tendency to rotate the CD about its own axis during the period of contact between the CD and the cleaning roller.

BRIEF SUMMARY OF THE INVENTION

According to a first aspect of the present invention there is provided a roller for the surface treatment of an article moving relative to the roller in a path which is substantially tangential to a circumference of the roller at the region of contact between the article and the roller, said path being arcuate in a plane which is substantially tangential to the roller at said region of contact, said roller having a longitudinal axis about which the roller rotates in use, the diameter of the roller about said longitudinal axis varying as a function of distance along said longitudinal axis from one longitudinal end of the roller to the other longitudinal end of the roller. The roller is preferably conical about said longitudinal axis.

According to a second aspect of the present invention there is provided a roller set for the surface treatment of an article moving relative to a predetermined one of the rollers of the set of rollers in a path which is substantially tangential to a circumference of the predetermined roller at the region of contact between the article and the predetermined roller, said path being arcuate in a plane which is substantially tangential to the predetermined roller at said region of contact, each roller in the roller set being in rolling contact with at least one other roller of the set, said predetermined roller having a longitudinal axis about which the predetermined roller rotates in use of the roller set, the diameter of the predetermined roller about said longitudinal axis varying as a function of distance along said longitudinal axis from one longitudinal end of the predetermined roller to the other longitudinal end of the predetermined roller.

The predetermined roller is preferably conical about said longitudinal axis, and each other roller of the roller set is preferably also conical with notional extensions in the respective convergent direction of the longitudinal axis of the predetermined roller and of a respective longitudinal axis of each other roller preferably intersecting substantially at a common point.

According to a third aspect of the present invention, there is provided surface treatment equipment for the surface treatment of an article, the equipment comprising an indexing turret machine wherein there is a holder means for temporarily securing the article, the holder means being mounted on mounting means for movement of the holder means and of an article secured thereby in an arcuate path which is substantially circular about a machine axis, the equipment further comprising a roller set according to the second aspect of the present invention, the roller set being mounted with respect to the machine such that said arcuate path of the second aspect of the present invention substantially corresponds to the arcuate path of the third aspect of the present invention, and such that the predetermined roller is convergent in a direction substantially towards the machine axis.

In the preferred arrangement of the roller set wherein each roller is conical and the respective roller axes intersect substantially at a common point, the roller set is preferably mounted with respect to the machine such that said common point lies substantially on the machine axis.

In each aspect of the invention, the roller contacting the article may have a periphery formed of or coated with a substance which is tacky such that contact with the article tends to cause particulates on the surface of the article to adhere to the tacky substance whereby to clean the surface of the article, and in the second and third aspects of the invention, the roller in rolling contact with the predetermined roller (which has the tacky periphery) preferably has a periphery formed of or coated with a further substance which is more tacky than the substance forming or coating the periphery of the predetermined roller such that particulates transferred from the surface of the article to the periphery of the predetermined roller are subsequently transferred to the periphery of the roller in rolling contact with the predetermined roller whereby to obviate or mitigate an accumulation of particulates on the periphery of the predetermined roller.

Embodiments of the invention will now be described by way of example, with reference to the accompanying drawings, wherein.

DETAILED DESCRIPTION

Figure 1:
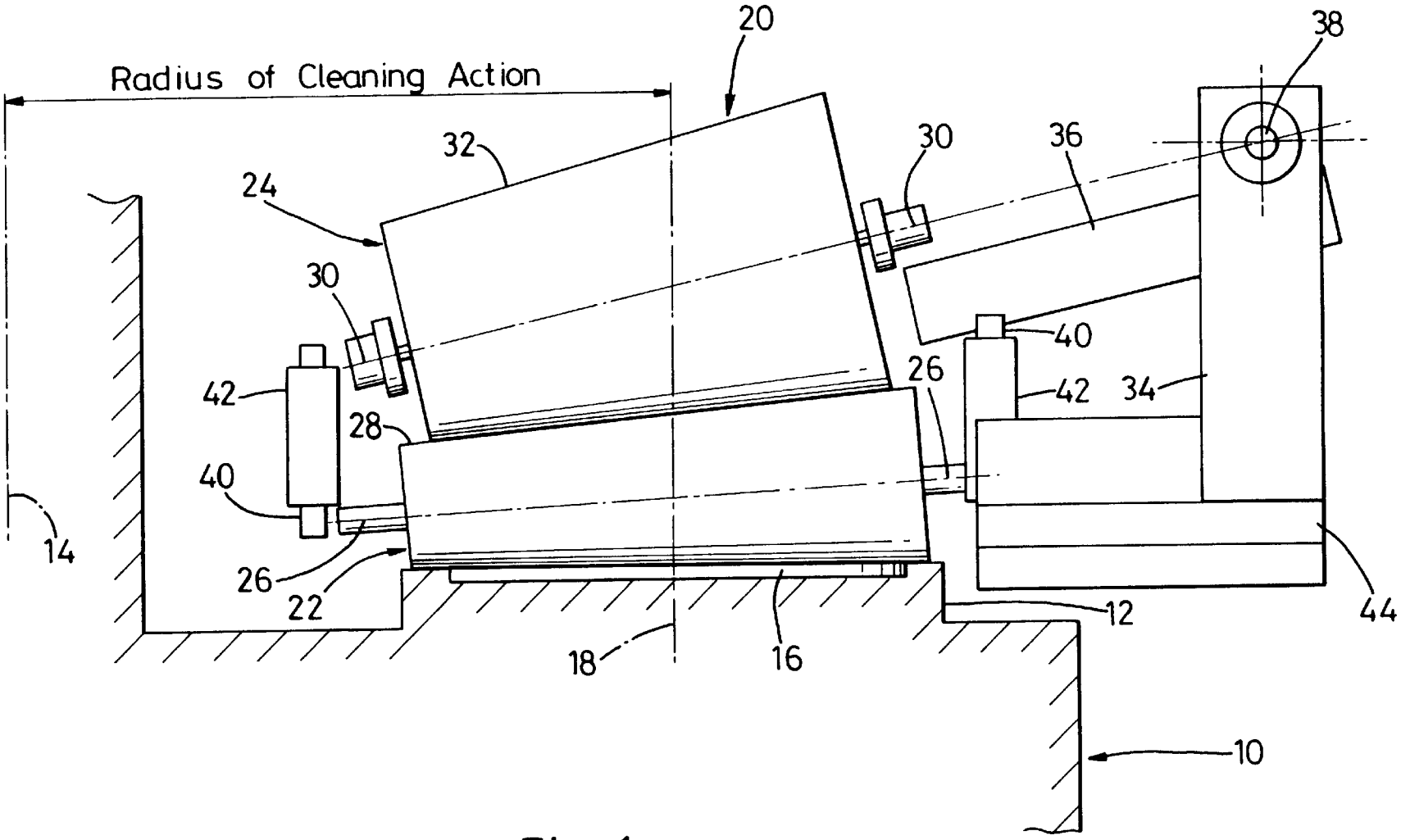
FIG. 1 is a schematic elevation of a first embodiment of the invention.

Referring first to FIG. 1 (which schematically illustrates the first embodiment), an indexing turret machine 10 comprises a workpiece holder 12 mounted for movement in a horizontal circle about a central vertical rotation axis 14 of the machine 10. The holder 12 is internally shaped to carry a CD 16 with its upper surface horizontal and flush with or proud of the holder 12. The CD axis 18 is vertical and parallel to but horizontally offset from the turret axis 14.

A roller set 20 is mounted on or adjacent the machine 10. The roller set 20 comprises a cleaning or working roller 22 and an adhesive or backup roller 24.

The working roller 22 has a longitudinal axis 26 and the roller 22 is mounted by suitable bearings (not illustrated in FIG. 1) for rotation about the axis 26 which is aligned (as viewed from above) substantially on a radius of the machine 10 centred on the machine's rotation axis 14. The periphery 28 of the working roller 22 is frusto-conical about the roller's longitudinal axis 26 and convergent in a direction towards the machine axis 14. The longitudinal axis 26 of the working roller 22 is inclined to the horizontal in a direction which descends towards the machine axis 14 at the half-angle of the cone formed by the roller periphery 28 such that the underside of the working roller 22 is substantially horizontal.

The backup roller 24 has a longitudinal axis 30 and the roller 24 is mounted by suitable bearings (not illustrated in FIG. 1) for rotation about the axis 30 which is aligned (as viewed from above) substantially on the same radius of the machine 10 as the radius with which the working roller axis 26 is aligned. The periphery 32 of the backup roller 24 is frusto-conical about the roller's longitudinal axis 30 and convergent in a direction towards the machine axis 14. The longitudinal axis 30 of the backup roller 24 is inclined to the horizontal in a direction which descends towards the machine axis 14 at an angle such that the underside of the backup roller periphery 32 is in rolling contact with the topside of the working roller periphery 28.

A suitable mechanism 34 and mounting arm 36 allow the roller 24 to be adjusted vertically, e.g. to be lifted clear for maintenance or repair, by upward pivoting of the roller-mounting arm 36 about a horizontal axis pivot 38.

The working roller 22 is positioned so as to exert a uniform and non-skewing rolling downforce on the upper surface of the CD 16 as it is carried on its curved path under the roller set 20 by horizontal rotation of the holder 12 around the vertical rotation axis 14 of the indexing turret machine 10. At the same time, the backup roller 24 is in uniform rolling contact with the working roller 22. Conformity of the working roller 22 with the upper surface of the CD 14 is ensured by mounting the bearings of the roller 22 on vertically slidable pillars 40 such that the roller axis 26 can rise and fall as necessary. The pillars 40 slide through respective mounting blocks 42 secured to a mounting frame (not shown in FIG. 1) for the roller set 20.

The rolling down force exerted on the CD 16 by the working roller 22 can be fine-tuned to eliminate any residual skewing effects by slight rotation of the roller set 20 about an outboard vertical axis extending through the centre of a rotatable mounting pillar 44.

The periphery 28 of the working roller 22 is coated or covered with a suitable adhesive substance such as a silicone. The adhesive substance on the roller 22 has a tackiness which causes adherence to the roller 22 of dust and other undesirable particulates on the upper surface of the CD 16 as the CD is carried under the roller set 20 in rolling contact with the periphery 28 of the working roller 22. Thereby the upper surface of the CD 16 is cleaned as it is carried between workstations (not shown) on the machine 10.

The periphery 32 of the backup roller 24 is coated or covered with a suitable adhesive substance such as a silicone. The adhesive substance on the periphery 32 of the backup roller 24 has a tackiness which exceeds the tackiness of the adhesive substance on the periphery 28 of the working roller 22 such that the dust and other particulates picked up by the working roller 22 are transferred to the backup roller 24 by their mutual rolling contact. This transfer prevents a build-up of particulates on the working roller 22 with consequent loss of its cleaning effect. The peripheral surface layer of the backup roller 24 is preferably a self-adherent sheet which is removable and replaceable when overly dirty. (The roller 24 will be raised off the working roller 22 for such replacement by upward pivoting of the arm 36.)

The holder 12 can readily be shaped so as positively to prevent a CD from undergoing lateral displacement, but a CD cannot readily be clamped against rotation about its own axis such as to leave its upper surface entirely free of any part of a clamping mechanism. Edge-clamping mechanisms may cause unacceptable distortion of or damage to a CD and therefore may not be substituted for a top-clamping mechanism. With the present invention any need for CD clamping is obviated and difficulties in preventing the CD 16 from rotating about its own axis 18 are avoided, by reason of the inherent lack of any rotation effect on the CD 16 arising from contact with the cleaning roller 22, due to the conicity of the roller 22 about a hypothetical point where the machine's rotation axis 14 intersects the notional horizontal plane including the upper surface of the CD 16.

Use of a cylindrical cleaning roller on a CD or other article travelling in a curved path would have an inevitable twisting effect on the article due to the differential movement of the article with respect to the cylindrical periphery arising from the proportionality of article velocity to radius (contrasted with the uniform linear velocity across the periphery of the cylindrical cleaning roller).

If, for example, the machine 10 were being employed in a multi-colour printing process for creating a "label" on the CD 16, with a separate colour being applied at each workstation, any twisting of the CD between workstations would put the successive colours out of register and thus spoil the CD. The present invention enables this undesirable consequence to be avoided.

A duplicate of the machine 10 could be disposed ahead of each workstation in the printing process, such that the CD was cleaned without being twisted immediately prior to application of each of the separate colours.

While the use of a conical backup roller 24 obviates any differential velocity with respect to the working roller 22, use of a backup roller which is cylindrical may not cause any adverse or unacceptable effect.

Figure 2:
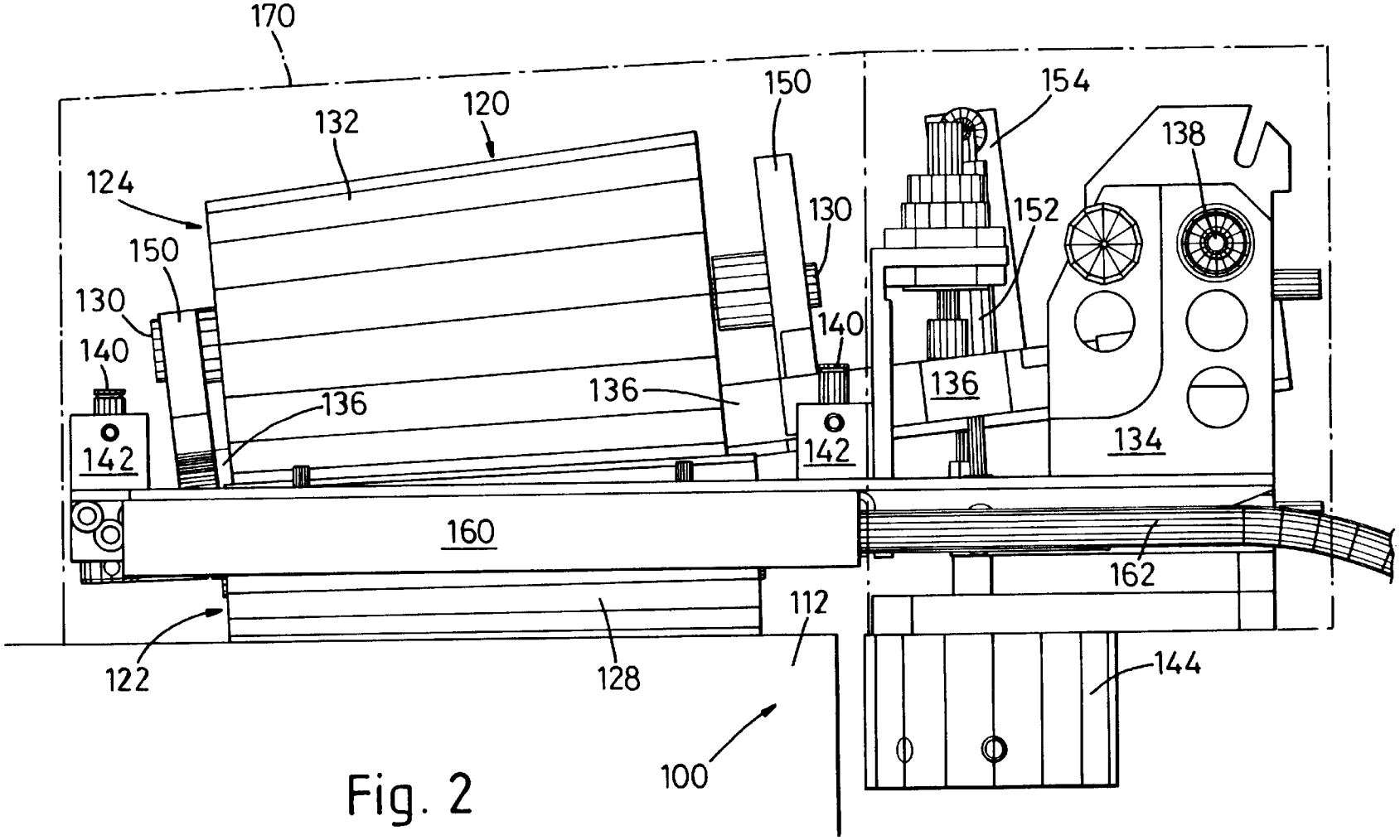
FIG. 2 is an elevation of a preferred embodiment of the invention in its operating configuration.
Figure 3:
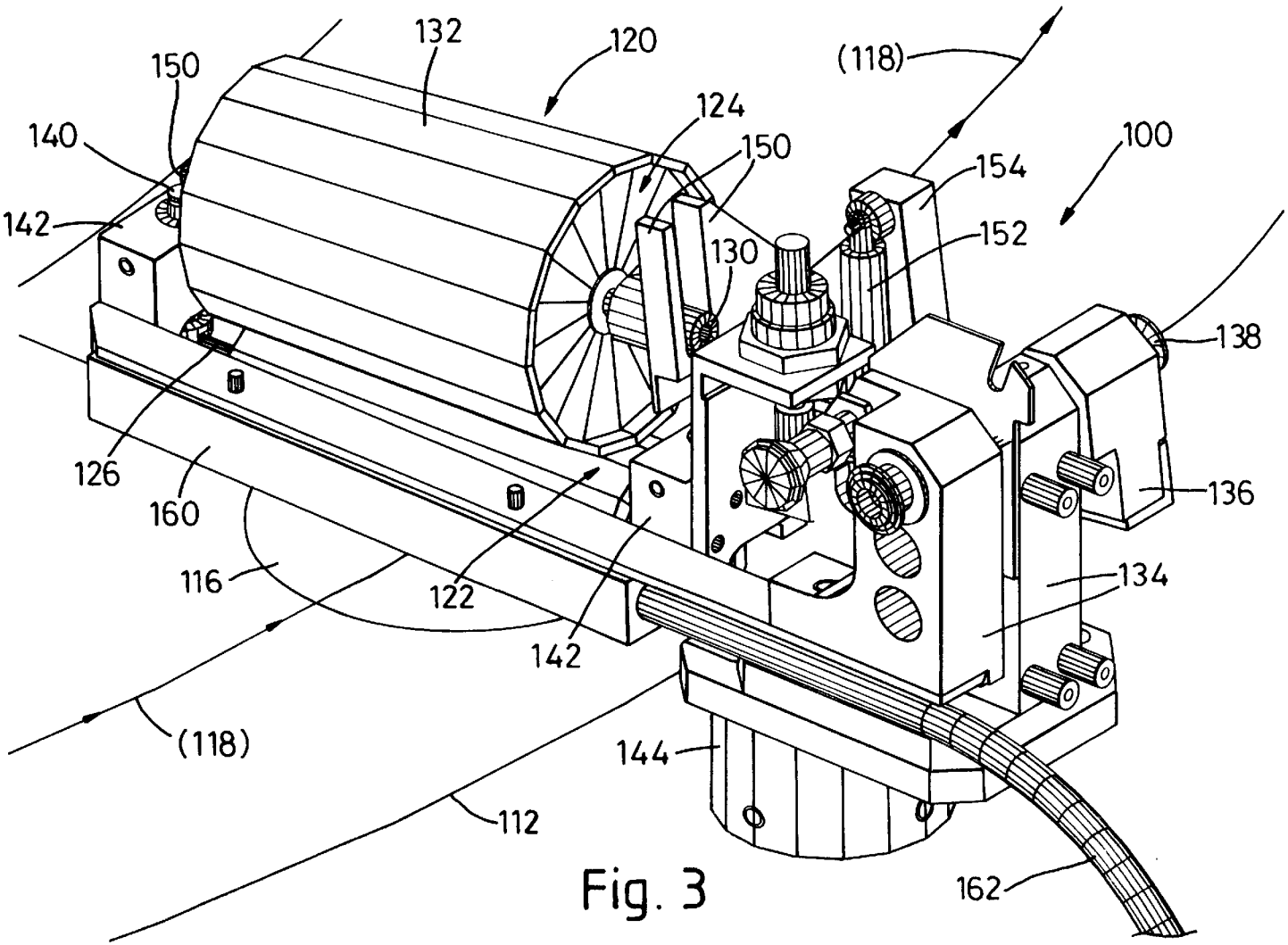
FIG. 3 is a perspective view of the embodiment of FIG. 2, in the same operating configuration.

Referring now to FIGS. 2 and 3, these show an elevation and a perspective view, respectively, of a preferred embodiment of the invention. (FIGS. 2 and 3 are rendered semi-schematically, in that certain surfaces are depicted as a series of planar strips whereas they are actually smoothly curved and free of the peripheral discontinuities suggested by the computer-generated drawing style of FIGS. 2 and 3; these comments also apply to FIGS. 4 and 5.)

By comparing FIG. 2 to the equivalent FIG. 1, it will be seen that the embodiment shown in FIG. 2 has the same fundamental features that were described with reference to FIG. 1, but in more developed form and alone with various other features which will be detailed below. Accordingly, these parts and assemblies of the preferred embodiment of FIGS. 2 to 5 which are identical or equivalent to parts and assemblies of the FIG. 1 embodiment will be given the same reference numeral but preceded by a "1" (i.e. certain of the reference numerals in FIGS. 2 to 5 are the corresponding reference numerals from FIG. 1, plus "100"). The following description of the preferred embodiment will concentrate on features differing from the FIG. 1 embodiment, and hence for a full description of any part of the preferred embodiment not dealt with below, reference should be made to the foregoing description of the identical or equivalent parts of the FIG. 1 embodiment.

As may be seen from FIG. 2 and more especially from FIG. 3, the roller-mounting arm 136 extends along one side of the preferred embodiment of the indexing turret machine 100, namely the far side as viewed in FIG. 2. From the arm 136, two roller-mounting slides 150 extend towards the median plane of the roller set 120. Each of the slides 150 is in the form of a deep open-topped U-shaped fork which allows each end of the axle 130 of the backup roller 124 to move freely in a vertical direction while restraining the axle 130 both laterally and longitudinally. Thereby the slides 150 keep the backup roller 124 perfectly tracking as it rolls over the working roller 122 rotating beneath the backup roller 124, while allowing the backup roller 124 to apply only its own weight as a vertical loading on the underlying working roller 122.

When it is desired to replace the dirt-collecting adherent surface layer of the backup roller 124, air pressure is applied to a linearly extensible air actuator 152 pivotally linked at its lower end to the frame of the mechanism 134, and pivotally linked at the upper end to the upper end of a bracket 154 fixed to and extending upwardly from the arm 136. Extension of the actuator 152 lifts the arm 136 (FIGS. 4 and 5) thereby lifting the backup roller 124 off the working roller 122. Thereupon the dirt-leaving surface layer of the backup roller 124 can be peeled off, and replaced by a fresh surface in readiness for further dirt collection. This surface layer (not shown separately) is preferably shaped to be a substantially exact fit on the circumferential periphery of the backup roller 124, i.e. the layer is shaped as a development of the truncated cone which is the fundamental shape of the backup roller 124.

Since the tackiness or adherence of the surface of the working roller 122 in relation to the tackiness or adherence of the surface of the backup roller 124 is such that particulates and other undesirable debris picked up by the working roller 122 are transferred to the backup roller 124, any need to replace the surface layer of the working roller 122 is minimised or obviated, certainly in relation to the frequency of needed replacement of the surface layer of the backup roller 124. However, the surface layer of the working roller 122 can be made replaceable as and when desirable or necessary. (Alternatively, the entire working roller 122 could be replaced, as could the entire backup roller 124.)

Performance of the machine 100 is enhanced by the provision of a static eliminator 160 for dissipation of static electricity on the CDs 116 being cleaned by the machine 100. The static eliminator 160 is energised via an insulated cable 162.

Figure 4:
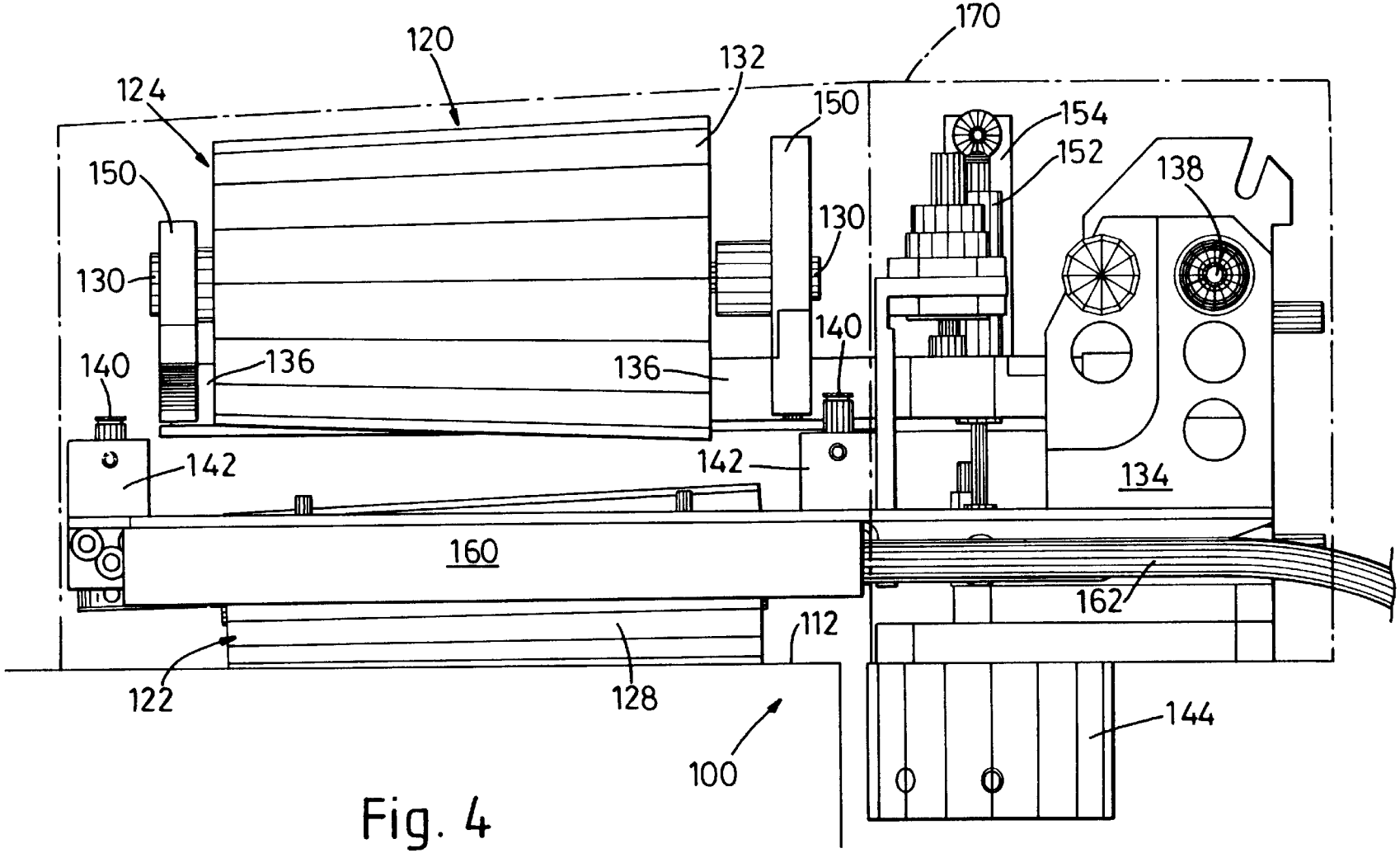
FIG. 4 is an elevation of the embodiment of FIG. 2, re-configured to its maintenance configuration.

FIGS. 2 and 4 (but not FIGS. 3 and 5) show a machine cover 170 in ghost outline. The cover 170 is selectively removable and when in place serves to protect the machine components from potentially disruptive external influences. The cover 170 also serves as a safety shield to prevent human contact with the working components of the machine 100 when it is in operation.

Figure 5:
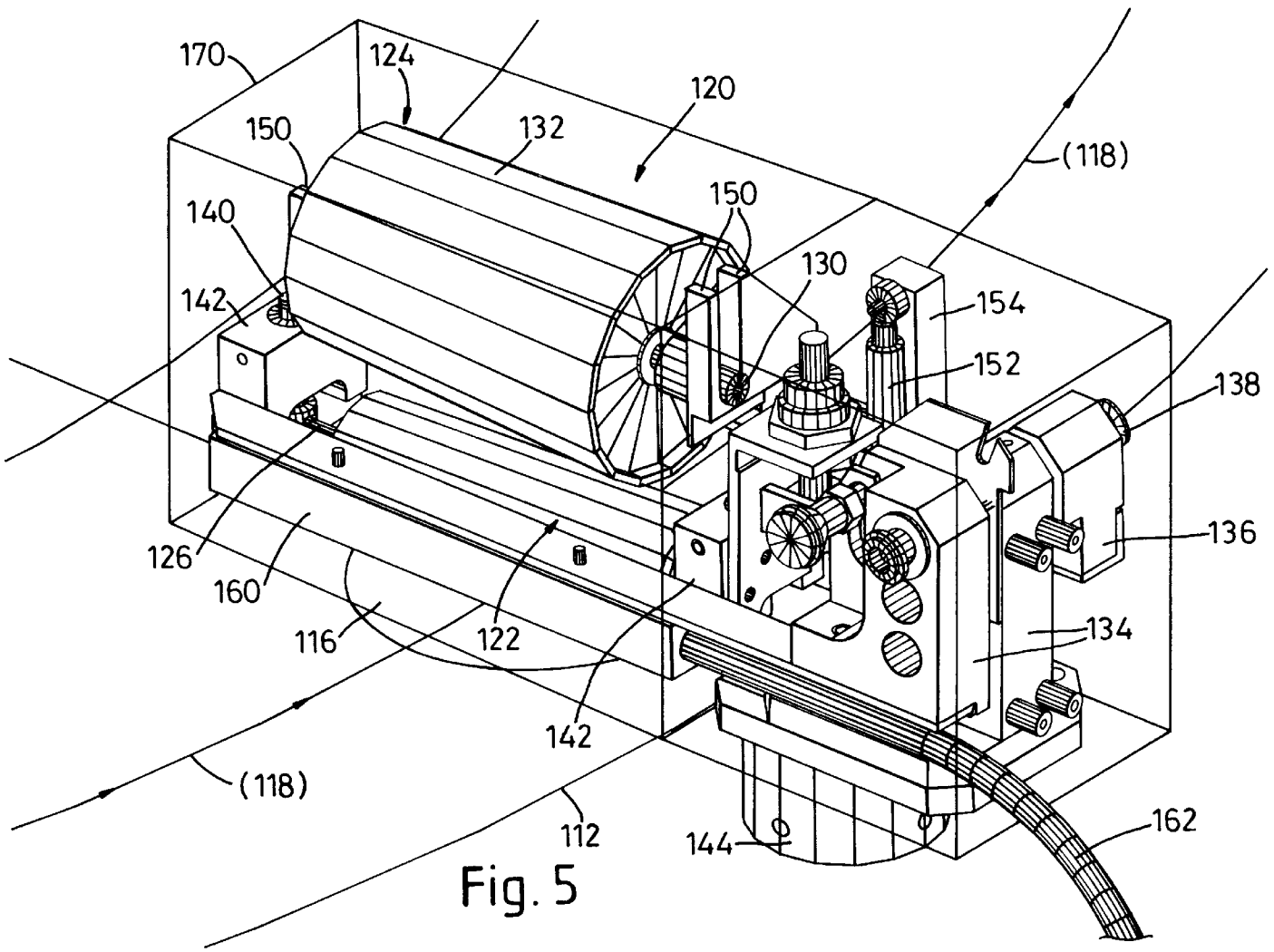
FIG. 5 is a perspective view of the re-configured embodiment of FIG. 4, in the same maintenance configuration.

Although only a single CD cleaning machine 100 is shown in FIGS. 2 and 5, it is possible (as with the machine 10 of FIG. 2) for a duplicate of the machine 100 to be placed immediately upstream (ahead) of each printing stage of a multi-stage CD label printing process, where each of these stages is distributed around the CD holder turret 112 of which only part is shown in FIGS. 3 and 5. (In FIGS. 3 and 5, the path of the centre of a CD 116 moving through the machine 100 is denoted by the reference "118"). Thereby each CD would be cleaned immediately prior to each stage of printing, but without the risk of having the CDs rotated between stages (this risk arising from the need to avoid clamping the CDs in order to avoid distortions of the CDs).

While certain modifications and variations of the invention have been described above, the invention is not restricted thereto, and other modifications and variations can be adopted without departing from the scope of the invention as defined in the appended claims.

We claim:

1. A device for surface treatment comprising a roller for the surface treatment of an article moving relative to the roller in a path which is substantially tangential to a circumference of the roller at the region of contact between the article and the roller, said path being arcuate in a plane which is substantially tangential to the roller at said region of contact, said roller having a longitudinal axis about which the roller rotates in use, the diameter of the roller about said longitudinal axis varying as a function of distance along said longitudinal axis from one longitudinal end of the roller to the other longitudinal end of the roller, the roller having a periphery formed of or coated with a substance which is tacky such that contact with the article tends to cause particulates on the surface of the article to adhere to the tacky substance whereby to clean the surface of the article.

2. The device as claimed in claim 1 wherein the roller is conical about said longitudinal axis.

3. An apparatus for surface treatment comprising a roller set for the surface treatment of an article moving relative to a predetermined one of the rollers of the set of rollers in a path which is substantially tangential to a circumference of the predetermined roller at the region of contact between the article and the predetermined roller, said path being arcuate in a plane which is substantially tangential to the predetermined roller at said region of contact, each roller in the roller set being in rolling contact with at least one other roller of the set, said predetermined roller having a longitudinal axis about which the predetermined roller rotates in use of the roller set, the diameter of the predetermined roller about said longitudinal axis varying as a function of distance along said longitudinal axis from one longitudinal end of the predetermined roller to the other longitudinal end of the predetermined roller, said predetermined roller having a periphery formed of or coated with a substance which is tacky such that contact with the article tends to cause particulates on the surface of the article to adhere to the tacky substance whereby to clean the surface of the article.

4. The apparatus as claimed in claim 3 wherein the predetermined roller is conical about said longitudinal axis.

5. The apparatus set as claimed in claim 4 wherein each roller of the roller set is also conical with extensions in the respective convergent direction of the longitudinal axis of the predetermined roller and of a respective longitudinal axis of each other roller intersecting substantially at a common point.

6. The apparatus as claimed in claim 3, wherein the roller in rolling contact with the predetermined roller has a periphery formed of or coated with a further substance which is more tacky than the substance forming or coating the periphery of the predetermined roller such that the particulates transferred from the surface of the article to the periphery of the predetermined roller are subsequently transferred to the periphery of the roller in rolling contact with the predetermined roller whereby to obviate or mitigate an accumulation of particulates on the periphery of the predetermined roller.

7. Surface treatment equipment for the surface treatment of an article, the equipment comprising an indexing turret machine wherein there is a holder means for temporarily securing the article, the holder means being mounted on mounting means for movement of the holder means and of an article secured thereby in an arcuate path which is substantially circular about a machine axis, the equipment further comprising a roller set according to claim 3, the roller set being mounted with respect to the machine such that said arcuate path of the roller set substantially corresponds to the arcuate path of movement of the holder means and of an article secured thereby, and such that the predetermined roller is convergent in a direction substantially towards the machine axis.

8. Surface treatment equipment as claimed in claim 7 wherein each roller of the roller set is conical and the respective roller axes intersect substantially at a common point, the roller set being mounted with respect to the machine such that said common point lies substantially on the machine axis.

9. Surface treatment equipment as claimed in claim 7, wherein the roller contacting the article has a periphery formed of or coated with a substance which is tacky such that contact with the article tends to cause particulates on the surface of the article to adhere to the tacky substance whereby to clean the surface of the article, and the roller in rolling contact with the predetermined roller has a periphery formed of or coated with a further substance which is more tacky than the substance forming or coating the periphery of the predetermined roller such that particulates transferred from the surface of the article to the periphery of the predetermined roller are subsequently transferred to the periphery of the roller in rolling contact with the predetermined roller whereby to obviate or mitigate an accumulation of particulates on the periphery of the predetermined roller.

* * * * *